US005380081A

United States Patent [19]

Vogt

[11] Patent Number: 5,380,081

[45] Date of Patent: Jan. 10, 1995

[54] HOLDING DEVICE FOR SACKS OR THE LIKE

[76] Inventor: Peter Vogt, Dannebergplatz 9, 1030 Vienna, Austria

[21] Appl. No.: 186,311

[22] Filed: Jan. 24, 1994

Related U.S. Application Data

[63] Continuation of Ser. No. 678,103, Apr. 1, 1991, abandoned.

[30] Foreign Application Priority Data

Apr. 3, 1990 [AT] Austria ..... 766/90

[51] Int. Cl.[6] ..... A47G 29/14

[52] U.S. Cl. ..... 312/212; 248/97; 248/99

[58] Field of Search ..... 312/258, 259, 330.1, 312/3, 6, 211, 212; 108/26; 220/6; 248/97, 99, 100, 907, 101

[56] References Cited

U.S. PATENT DOCUMENTS 2,625,973 1/1953 Weldon et al. ..... 248/99
4,979,705 12/1990 Bovitz ..... 248/99

FOREIGN PATENT DOCUMENTS 1207259 12/1965 Germany .
1586264 7/1970 Germany .
1317995 5/1973 United Kingdom .

*Primary Examiner*—Kenneth J. Dorner
*Assistant Examiner*—Gerald A. Anderson
*Attorney, Agent, or Firm*—Henry M. Feiereisen

[57] ABSTRACT

A holding device for sacks or the like includes an enclosed frame assembly with open top and retaining rods bridging the open top of the frame assembly and movably and detachably supported with its opposing ends by the frame assembly. Each retaining rod is provided for detachably holding one or two neighboring sacks along their facing upper edge via suitable mountings.

10 Claims, 6 Drawing Sheets

HOLDING DEVICE FOR SACKS OR THE LIKE

This is a continuation of application Ser. No. 07/678,103, filed Apr. 1, 1991, now abandoned.

BACKGROUND OF THE INVENTION

The invention refers to a holding device for sacks or the like, and in particular to a sack holding device of the type having a holder which allows detachable mounting of several sacks.

Sacks are frequently used to collect trash or garbage of different kind and are transported away after being filled. Upon using sacks for collection of garbage, it is desired to separate the garbage at location in dependence of the type of garbage. For that reason, the sacks should be easily accessible since otherwise the separation of garbage will be more cumbersome, and the holding device should allow easy removal and exchange of sacks.

A drawback encountered in all conventional sack filling devices to date is the fact that they are generally equipped for only one sack which receives indiscriminate garbage and is removed after being filled and replaced by another like sack. This limits the application of conventional sack filling devices.

SUMMARY OF THE INVENTION

It is thus an object of the present invention to provide an improved holding device for sacks or the like obviating the afore-stated drawbacks.

This object and others which will become apparent hereinafter are attained in accordance with the present invention by providing an enclosed frame assembly by which the opposing ends of the retaining rods are movably supported to allow positional adjustment of the retaining rods, and by providing mountings for detachably securing the upper edge of the sacks to the retaining rod.

By providing a holding device according to the invention, it is possible to make available several sacks which can easily be kept open to allow separate filling of a wide variety of garbage such as organic refuse, glass, metal, special garbage etc. After being filled, a sack can be separately removed and transported away and replaced by another sack with open feed opening. The individual sacks can be differently marked, e.g. by coloring, for differentiating the types of collected refuse. Also, attachment of the sacks to the retaining rods is simple and can be done at a selected location so as to facilitate the collection. Since the retaining rods are movably supported by the frame assembly, the feed opening of each sack can adjust automatically to the respective filling level. It is, however, also possible to limit the mobility of the retaining rods by providing about the frame suitable indentations which are engageable by the ends of the retaining rods.

According to one embodiment of the present invention, the enclosed frame assembly is tetragonal, with two opposing crossbeams supporting the retaining rods which bridge the frame opening. Each retaining rod is provided with mountings in form of a slide with projecting hook for attachment of the upper edge of the sack. Suitably, each slide may be provided with a hook at each side thereof so that one retaining rod may be used to hold upper edges of two neighboring sacks.

According to another embodiment of the present invention, the holding device may include a column which swingably supports one end of the retaining rods. Radially spaced from and surrounding the column is a circular support frame which supports the other free end of the retaining rods in a manner as to allow movement and positional adjustment of the retaining rods. Also in this case, the feed opening of the sacks self-adjusts to the respective filling level. Alternatively, the holding device may be provided with a locking mechanism by which the position of the retaining rods is fixed so as to permit control of the spacing between neighboring retaining rods and to provide a selected sack opening size which can be maintained throughout.

In both embodiments, the opposing ends of the retaining rods are sufficiently supported to prevent an undesired bending when the weight of the filling in the sacks reaches certain levels.

The support of the ends of the retaining rods can be attained in various ways. Preferably, the frame is of C-shaped configuration in which the rod ends movably rest, with the rod ends being preferably of T-shape or angled. It is also possible to support the rod ends in ball bearings or needle bearings in the frame assembly.

For detachably securing the sacks, the retaining rods may be provided with clamps or hooks, snap fasteners or the like which preferably are movably and lockably mounted to the retaining rods. By movably arranging these mountings for the sacks, it is not only possible to hold sacks with differently spaced holes or eyelets for attachment to the mountings but also conventional shopping bags can be used, with their handles being attached to the respectively positioned mountings. In this case, these shopping bags can be used for another purpose before being destroyed.

The holding device according to the invention is characterized through a great versatility as existing containers can easily be equipped with such a holding device by simply placing the frame assembly upon the rim of the container or by using the rim of the container itself for providing the frame assembly. For example, existing circular barrels can be utilized by simply placing the column with the swingably mounted retaining rods within the barrel, with the rim of the barrel supporting the free ends of the retaining rods so that different types of garbage can be separated and compiled at the point of origin.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
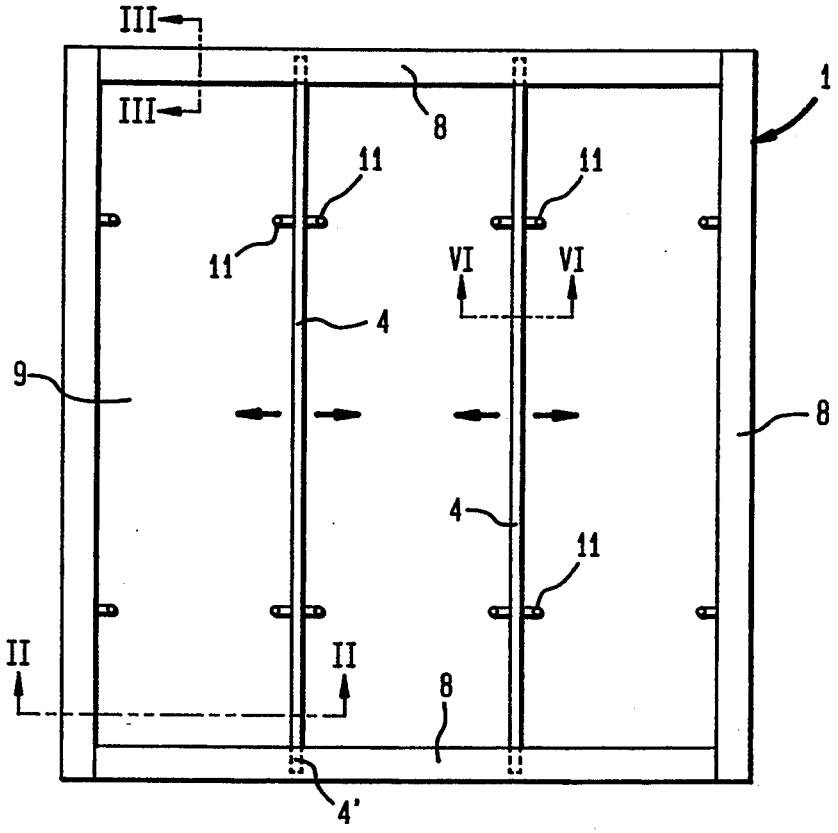
FIG. 1 is a plan view of one embodiment of a device for holding a sack or the like in accordance with the present invention.

Throughout the drawing, the same or corresponding elements are always indicated by the same reference numerals.

Figure 2:
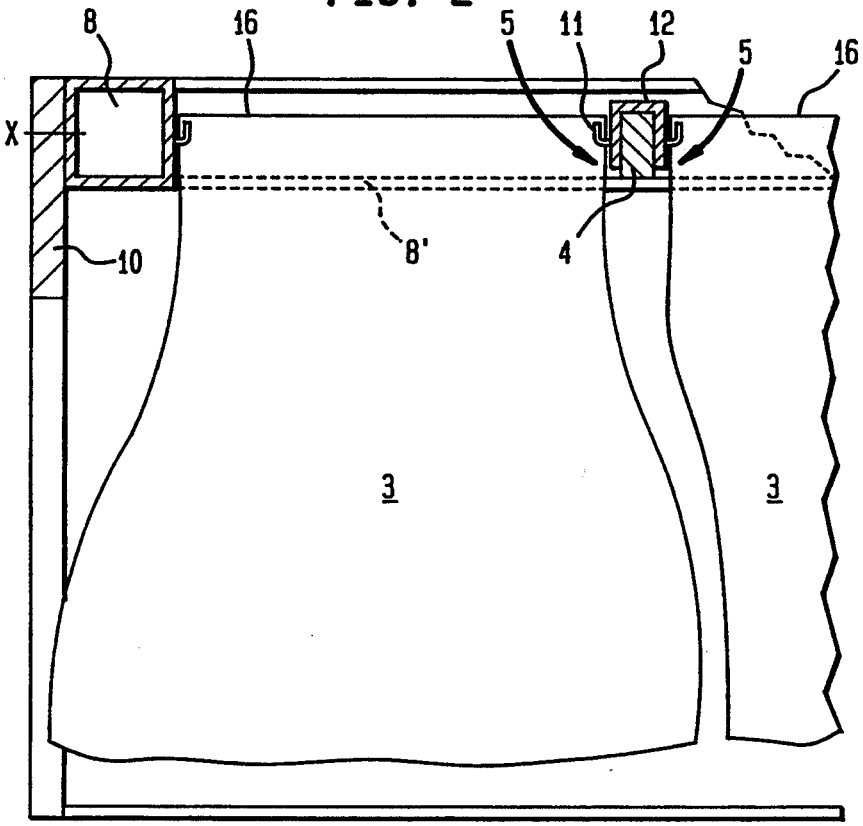
FIG. 2 is a sectional view of the holding device of FIG. 1, taken along the line II—II in FIG. 1.

Referring now to the drawing, and in particular to FIGS. 1 and 2, there are shown a plan view and a sectional view of one embodiment of a holding device for sacks or the like in accordance with the present invention. The holding device includes a holder or frame assembly, generally designated by reference numeral 1. In the nonlimiting example of FIG. 1, the frame assembly 1 includes an enclosed tetragonal (square or rectangular) support frame 8 which defines a frame opening 9. As shown in FIGS. 3 to 5 and 13, the support frame 8 includes at least two opposing crossbeams 8' of C-shaped configuration for supporting the projecting ends 4' of retaining rods 4 which extend between opposing crossbeams 8' and bridge the frame opening 9. In this manner, both ends of each retaining rod 4 are supported by the support frame 8 to thereby prevent the retaining rods 4 from bending when the sacks such as sacks 3 are filled and impose a substantial weight.

It will be appreciated that the retaining rods 4 are shown only by way of example and may be substituted with carrying plates or similar elements.

Figure 3:
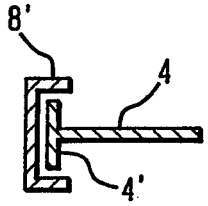
FIG. 3 is a fragmentary sectional view of the holding device taken along the line III—III in FIG. 1 and illustrating in detail the support of an exemplified retaining rod.

Turning now to FIG. 3 to 5 and 13, there are shown various fragmentary sectional views of the retaining rods 4, and in particular their support in the support frame 8. As shown in FIG. 3, the retaining rod 4 has an essentially T-shaped end 4' which rests in the C-shaped crossbeam 8'. In this manner, the retaining rod 4 can slide in longitudinal direction of the crossbeams 8', as indicated by the arrows in FIG. 1, to allow suitable adjustment upon attachment of the sacks 3. In view of the relative mobility of the retaining rods 4, the sack opening self-adjusts depending on the respective filling level.

Figure 4:
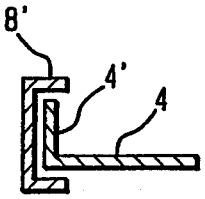
FIGS. 4 and 5 show fragmentary sectional views of modified supports of exemplified retaining rods.
Figure 5:
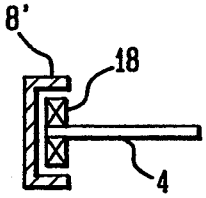
Figure 13:
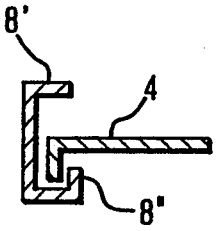
FIG. 13 is a fragmentary sectional view of a further modified support of exemplified retaining rods.

In FIG. 4, the end 4' of the retaining rod 4 is perpendicularly angled upwardly and sits in the C-shaped configuration of the crossbeams 8'. In order to improve the movability of the retaining rods 4 along the crossbeams 8' of the support frame 8, the ends 4' of the retaining rods 4 may be provided with suitable bearings 18, such as ball bearings or needle bearings, as shown in FIG. 5. In FIG. 13, the C-shaped configuration of the crossbeams 8' is slightly modified by providing an upwardly angled projection 8''. Engaging the thus-shaped crossbeams 8' are the ends 4' of the retaining rod 4 which are downwardly angled so that a detachment of the retaining rod 4 from the support frame 8 is prevented by the projections 8'' e.g. when the retaining rod 4 is tilted relative to the crossbeam 8'.

In order to securely hold the retaining rods 4 with their ends 4' in the support frame 8 in a desired position, the support frame 8 may be provided with suitable indentations (not shown) which are engageable by the ends 4' of the retaining rods 4. Suitably, the indentations are provided in the lower leg of the C-shaped crossbeams 8'.

Figure 9:
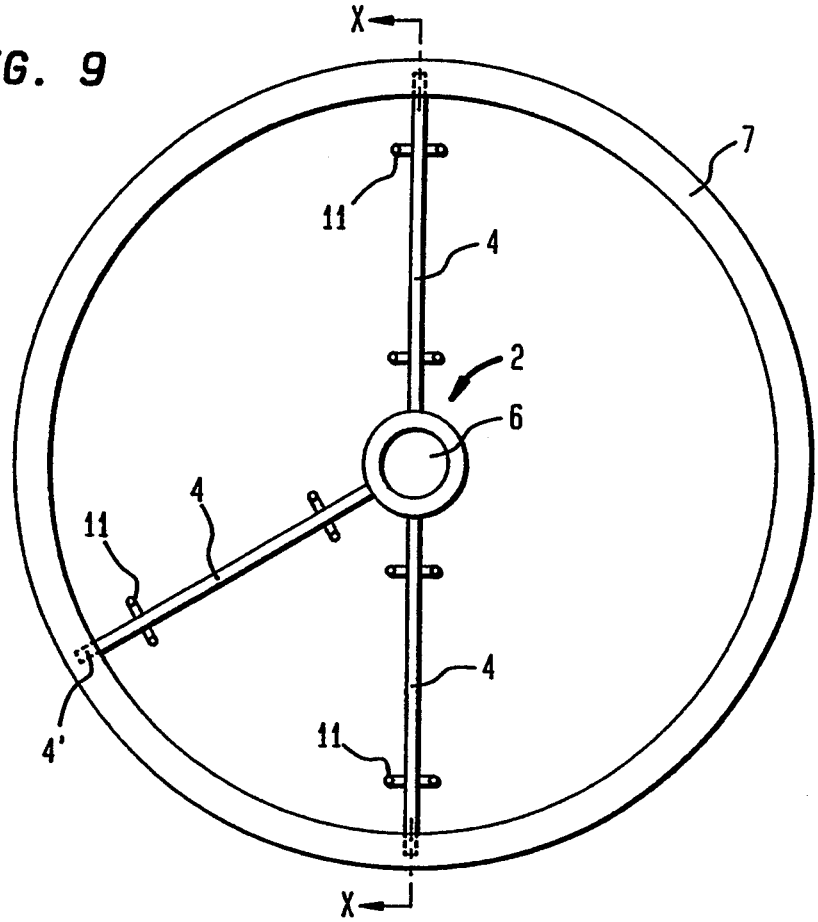
FIG. 9 is a plan view of another embodiment of a holding device for sacks or the like in accordance with the present invention.
Figure 10:
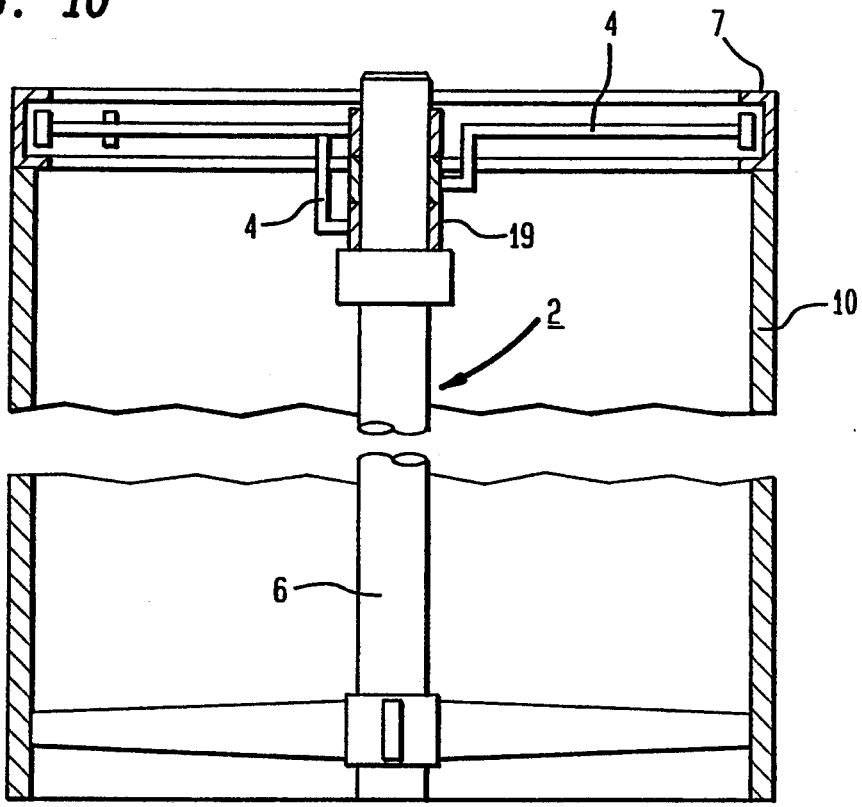
FIG. 10 is a sectional view of the holding device of FIG. 9, taken along the line X—X in FIG. 9.

Turning now to FIGS. 9 and 10, there are shown a plan view and a sectional view of another embodiment of a holding device for sacks 3 or the like in accordance with the invention. The holding device includes a holder or frame assembly which is generally designated by reference numeral 2 and configured in form of a vertical column 6 arranged or suitably mounted within a container 10. A plurality of retaining rods 4 (or retaining plates) are swingably mounted to the column 6 via respective bearing sleeves 19, as shown in particular in FIG. 10. It will be readily recognized that the retaining rods 4 may also be fixedly secured to the column 6, for example by threadably guiding a bolt through the bearing sleeve 19 so as to thereby urge the bearing sleeve 19 with its end face against the column 6.

Radially spaced from the column 6 is a circular support frame 7 which is preferably configured of U-shape (or C-shape) so that the free ends 4' of the retaining rod 4 can project into the support frame 7 and are securely supported thereby. Since both ends 4' of the retaining rods 4 are supported, i.e. by the column 6, on the one hand, and by the support frame 7, on the other hand, substantial weights of the sacks 3 will not cause an undesired bending of the retaining rods 4. Suitably, the free ends 4' of the retaining rods 4 may be provided with ball bearings or needle bearings which engage the U-shaped support frame 7. Also, the support frame 7 may be provided with indentations (not shown) which are engageable by the free ends 4' of the retaining rods 4 in order to fix the latter in a desired position. Suitably, the indentations are provided along the lower leg of the U-shaped support frame 7.

Figure 14:
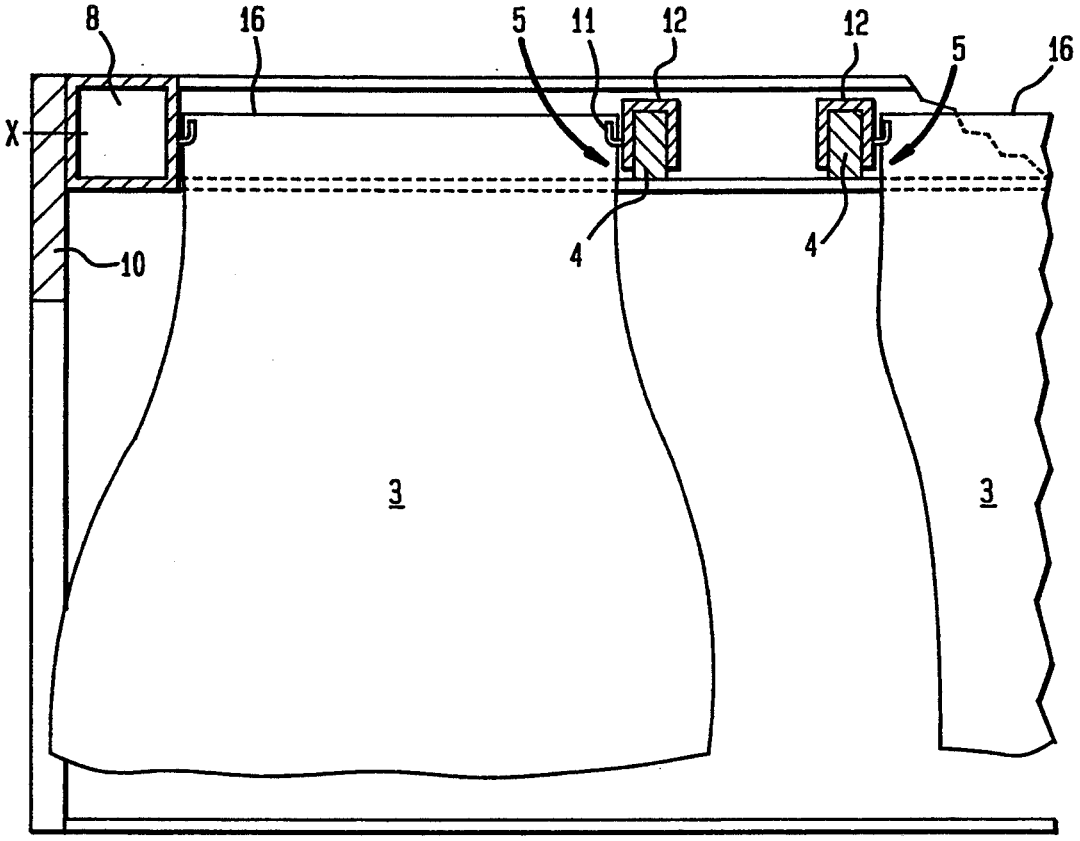
FIG. 14 is a sectional view of a modification of the holding device of FIG. 1.

In both embodiments as shown in FIGS. 1 and 9, the support frame 7 and 8, respectively, may be defined by the rim of a container 10 or be placed separately upon the rim of the container 10, as for example shown in FIG. 10, or be mounted about the inner perimeter of the opening of the container 10 as shown in FIGS. 2 or 14. In addition, it is also conceivable to mount the support frame for the retaining rods 4 on a stand which is supported by the base of the container 10, or the support frame may be mounted without container in form of a console to a wall or other suitable walling.

Figure 6:
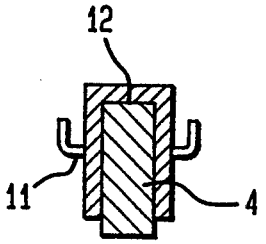
FIG. 6 is a fragmentary sectional view of the holding device taken along the line VI—VI in FIG. 1 and illustrating in detail a mounting means for allowing attachment of a sack.
Figure 7:
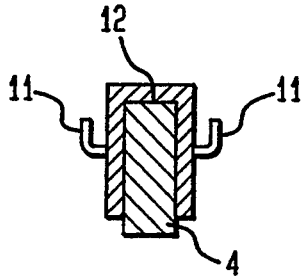
FIG. 7 is a fragmentary sectional view of a modified mounting means for sacks.
Figure 8:
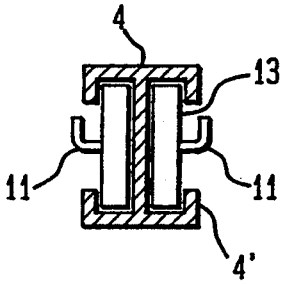
FIG. 8 is a further fragmentary sectional view of a modified mounting means for sacks and a complementary design of the retaining rods.
Figure 11:
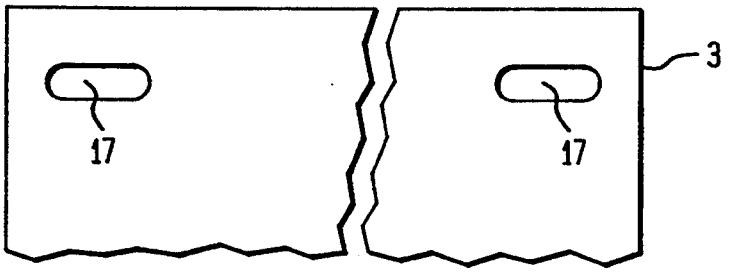
FIG. 11 is a fragmentary side elevational view of an exemplified sack for attachment in a holding device according to the invention.
Figure 12:
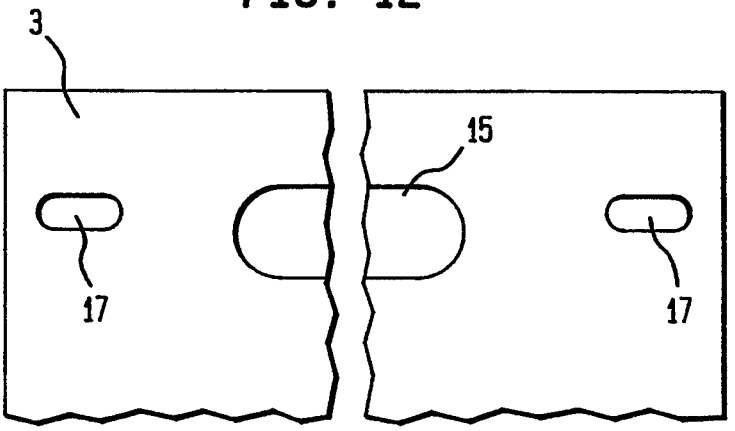
FIG. 12 is a fragmentary side elevational view of a modified example of a sack for attachment in a holding device according to the invention.

As further shown in FIGS. 2 and 9, and in particular in more detail in FIGS. 6 to 8, the retaining rods 4 are each provided with a plurality of hooks 11 which are spaced in longitudinal direction of the retaining rods 4 for detachably securing the sacks 3. Complementary to the hooks 11, the sacks 3 are provided with suitable holes 17 as shown in FIGS. 11 and 12 by which the sacks 3 are mounted to the hooks 11. Although not shown in detail, persons skilled in the art will readily recognize that clamps or snap fasteners may be provided in addition to or instead of the holes 17 for holding the sacks 3 to the retaining rods 4.

As shown in FIGS. 6 and 8, each hook 11 is part of a slide 12 which is placed over the upper edge of the retaining rod 4 and movable in longitudinal direction thereof. As shown in FIG. 6, the slide 12 has a hook 11 at one side only, while in FIG. 7, the slide 12 is provided with a hook 11 at each side thereof. In the latter case, the two hooks 11 of each slide 12 are in alignment with each other. If such arrangement is not desired, slides 12 with one-sided hook 11 may be employed so that the arrangement of the hooks 11 at both sides of the retaining rod 4 are not arranged directly aligned in opposite relationship. An example of a one-sided arrangement of hooks 11 is illustrated in FIG. 14 which is a sectional view of a modified exemplified embodiment of the holding device of FIG. 2. In the embodiments shown in FIGS. 1 and 9, the hooks 11 are lined up at both sides of the retaining rods 4 so that neighboring sacks 3 can be detachably secured along their facing upper edges 5 which define the respective feed openings 16 of the sacks 3.

A comparison of FIGS. 2 and 14 shows also that the use of slides 12 with one-sided alignment of the hooks 11 allows neighboring sacks 3 to be attached at greater mutual spacing.

Figure 1A:
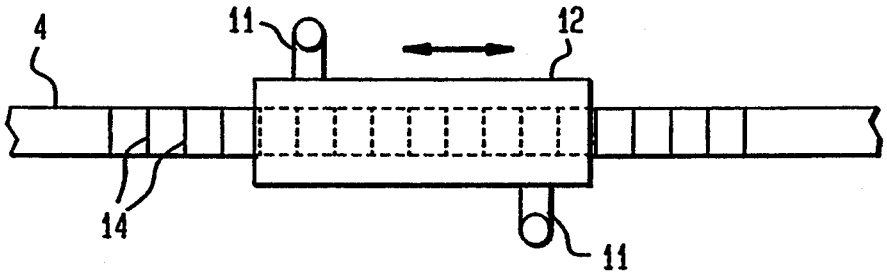
FIG. 1*a* is a fragmentary top view of the holding device of FIG. 1, illustrating in detail a section of a retaining rod provided with indentations to restrict a movement of a slider placed thereon.

The slides 12 may be randomly movable along the retaining rods 4. In order to limit the movement of the slides 12, the retaining rods 4 may be provided at their upper surface with indentations 14, shown in FIG. 1*a* (not shown) which are engageable by the slides 12 to keep them in position and to thereby prevent an unintentional displacement of the hooks 11.

A variation of the arrangement of the hooks 11 is shown in FIG. 8 in which the retaining rod 4 is of double-T-shape with angled ends 4' for securely retaining plates 13 within the thus-created space in the retaining rod 4. Each plate 13 is provided with a hook 11 which projects essentially perpendicularly beyond the opposing angled ends 4' to allow attachment of the sacks 3 via their holes 17. For insertion of the plates 13 into the space of the retaining rod 4, the angled projection of the ends 4' may be interrupted at a suitable location.

Referring now to FIGS. 11 and 12, there are shown two examples of sacks 3 which are usable with a holding device according to the invention and include the aforementioned holes 17 arranged slightly below the top edge of the sack 3. As already described, with these holes 17, a sack 3 is attached to the hooks 11 of the slides 12 which in turn are placed upon the retaining rod 4. Suitably, the sack 3 may be provided in vicinity of its upper edge with a central grip portion 15 which may also be used for attachment to one or two neighboring hooks 11 or for allowing a user to grasp and lift the sack 3.

Persons skilled in the art will recognize that the number of hooks 11 and thus the number of slides 12 is not limited to two along each retaining rod 4. Also, the sack 3 may be provided with additional holes 17 in vicinity of the open top to more securely allow positioning and holding of the sack 3.

Figure 15:
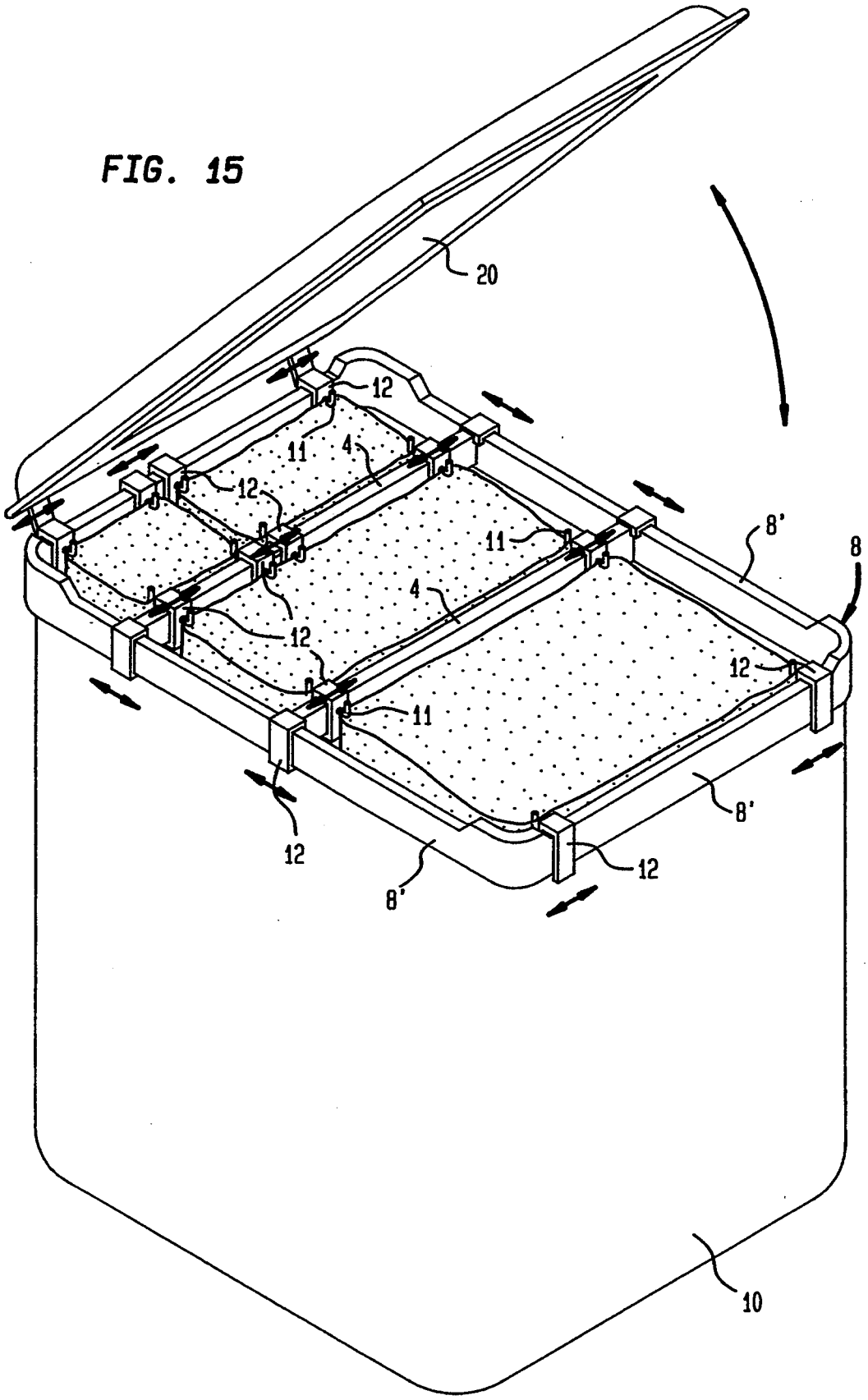
FIG. 15 is a perspective view of a holding device according to the invention for holding a variety of differently sized sacks, with the rim at the opening of an exemplified container constituting a frame assembly of the holding device.

Turning now to FIG. 15, there is shown a perspective view of a holding device for a plurality of differently sized sacks in accordance with the present invention. In this embodiment, the support frame 8 is of rectangular configuration and constitutes the rim of the container 10. It will be appreciated that the support frame may certainly be of round configuration as well. Swingably mounted to the support frame 8 by means of suitable hinges is a lid 20 so as to be able to seal the sacks 3 from the outside, as indicated by the double arrow. Although lid 20 is shown only in the embodiment of FIG. 15, it is certainly possible to provide each embodiment with such a lid.

As can be seen from the nonlimiting example of FIG. 15, the slides 12 are not only spaced along the retaining rods 4 but also along crossbeams 8' of the support frame 8 which are not engaged for support of the retaining rods 4. In this manner, the entire interior space of the container 10 can be utilized to allow attachment of several sacks and of sacks of different size. As shown for example at the left hand side of FIG. 15, two (and possibly more smaller sacks 3) are arranged between between the crossbeam 8' and the neighboring retaining rod 4. Certainly, such smaller sacks 3 may also be arranged between two adjacent retaining rods 4.

While the invention has been illustrated and described as embodied in a holding device for sacks or the like, it is not intended to be limited to the details shown since various modifications and structural changes may be made without departing in any way from the spirit of the present invention.

What is claimed as new and desired to be protected by Letters Patent is set forth in the appended claims:

I claim:

1. A holding device for sacks or the like; comprising:

an enclosed frame assembly having an open top;

holding means for supporting a sack along an upper edge defining a feed opening of the sack, said holding means bridging said open top and being supported in said frame assembly for movement in the direction of a first axis; and sack securing means for allowing detachable securement of the upper edge of the sack to said holding means, said sack securing means being attached to said holding means for allowing movement along a second axis perpendicular to said first axis so as to enable the feed opening of the sack to self-adjust along said first and second axes in dependence on the degree of filling.

2. A holding device as defined in claim 1 wherein said frame assembly includes opposing crossbeams for supporting said holding means and two further opposing crossbeams for defining an enclosed frame assembly of tetragonal configuration.

3. A holding device as defined in claim 2 wherein said mounting means includes slides movably arranged along said further crossbeams of said frame assembly.

4. A holding device as defined in claim 1 wherein said frame assembly includes locking means in form of indentations for restricting displacement of said holding means in direction of said first axis, and wherein said holding means includes locking means in form of indentations for restricting displacement of said sack securing means in direction of said second axis.

5. A holding device as defined in claim 1 wherein said frame assembly is defined by the rim of a container.

6. A holding device as defined in claim 1 wherein said frame assembly is placed upon a rim of a container.

7. A holding device as defined in claim 1 wherein said mounting means includes slides movably arranged along said holding means.

8. A holding device as defined in claim 7 wherein said slides are provided with at least one hook for allowing attachment of the upper edge of the sack.

9. A holding device as defined in claim 7 wherein said slides are provided with a hook at each side thereof for allowing attachment of facing upper edges of neighboring sacks.

10. A holding device as defined in claim 1 wherein said first axis is a horizontal axis.

* * * * *